US005202058A

United States Patent [19]

Riggs, Jr.

[11] Patent Number: 5,202,058

[45] Date of Patent: Apr. 13, 1993

[54] CORROSION INHIBITING METHOD AND INHIBITION COMPOSITIONS

[75] Inventor: Olen L. Riggs, Jr., Oklahoma City, Okla.

[73] Assignee: A.S. Incorporated, Benicia, Calif.

[21] Appl. No.: 788,530

[22] Filed: Nov. 6, 1991

[51] Int. Cl.[5] ..... C23F 11/10

[52] U.S. Cl. ..... 252/387; 252/392; 422/16

[58] Field of Search ..... 252/387, 396, 392; 422/16

[56] References Cited

U.S. PATENT DOCUMENTS 3,933,662 1/1976 Lowe ..... 252/387 X
4,866,969 9/1989 Shiba et al. ..... 354/202
4,913,830 4/1990 Lundberg ..... 252/49.6

*Primary Examiner*—Robert L. Stoll
*Assistant Examiner*—Valerie Fee
*Attorney, Agent, or Firm*—Harold D. Messner

[57] ABSTRACT

The present invention provides a method and compositions useful for inhibiting corrosion of a corrodible metal resulting from contact of water and air with the metal. In this method, a stannous salt and a hydrocarbyl substituted succinimide of a polyethylene polyamine are added to the water in minor amounts and cooperatively reduce corrosion of the metal to a substantially zero rate. While the amount of each agent for an effective inhibition is minor, say in the range of from about 0.1 to 100 ppm, a relatively concentrated solution is required for addition to the water. Suitable solvent media include the lower alkanols and mixture thereof with or without added water. Isopropanol is preferred. The solvent component of the compositions also varies depending upon the particular imide and/or salt component employed and the concentration desired. In general, the lower alkanol portion of the medium is in the range of from about 15 to 100 volume percent and the water portion is in the range of from about 0 to 85 volume percent. A medium in the range of from about 50 to 67 volume percent water is preferred. The relative amounts of the imide and stannous salt components desirably used varies depending upon the nature of the water in which the agents are employed. Satisfactory relative amounts by weight for each to the other at set forth above, are in the range of from about 0.5 to 10, preferably 0.8 to 2 and more preferably about 1 to 1 weight ratio.

46 Claims, No Drawings

CORROSION INHIBITING METHOD AND INHIBITION COMPOSITIONS

SCOPE OF THE INVENTION

The present invention relates to a method for inhibiting corrosion of corrodible ferrous metal in a water-metal-air contact system by means of a dual corrosion agent system and compositions for the practice of the method.

BACKGROUND OF THE INVENTION

Cooling water tower systems are usually fabricated of ferrous metal. A common problem is severe corrosion which results from water and air contact with the metal, especially in the case where the cooling water is brackish.

Chromate type inhibitors formerly used to reduce corrosion have been banned for use because of environmental impact problems. Consequently, there is a need for a new effective corrosion inhibitor system and, of course, for one which exhibits improved efficiency inhibiting corrosion and which employs materials free of deleterious environmental impact effects.

Inhibitors currently available to the art, for example, phosphate, phosphonate, molybdate, nitrite and zinc types and the like reduce carbon steel corrosion rates in brackish water to an amount on the order of 16 to 35 mills per year (mpy). This is a series rate and one hardly acceptable considering replacement and repair costs for cooling towers.

SUMMARY OF THE INVENTION

The present invention provides a method and compositions useful for inhibiting corrosion of ferrous metal resulting from contact of water and air with the metal. In this method, a stannous salt and a hydrocarbyl substituted succinimide of a polyethylene polyamine are added to the water in minor amounts and cooperatively reduce corrosion of the metal to a substantially zero rate. While the amount of each agent for an effective inhibition is minor, say in the range of from about 0.1 to 100 ppm, a relatively concentrated solution is required for addition to the water. Suitable solvent media include the lower alkanols and mixtures thereof with or without added water. Isopropanol is preferred. The solvent component of the compositions varies depending upon the particular imide and/or salt component employed and the concentration desired. In general, the lower alkanol portion of the medium is in the range of from about 15 to 100 volume percent and the water portion is in the range of from about 0 to 85 volume percent. A medium in the range of from about 50 to 67 volume percent water is preferred. The relative amounts of the imide and stannous salt components desirably used varies depending upon the nature of the water in which the agents are employed. Satisfactory relative amounts by weight for each to the other at set forth above, are in the range of from about 0.5 to 10, preferably 0.8 to 2 and more preferably about 1 to 1 weight ratio.

DETAILED DESCRIPTION OF THE INVENTION

The present invention is based upon novel corrosion inhibitor compositions and their cooperative use in a method wherein corrosion of corrodible ferrous metals, e.g., low carbon, silica and mild steels and the like, is reduced to a negligible rate.

The corrosion inhibiting agents required for the practice of the present invention must disperse readily in water, especially brackish water. While the amount of each of the agents required for an effective inhibition is minor, e.g., in the range of from about 0.1 to 100 ppm, preferably 0.5 to 10 ppm, a relatively concentrated solution is required before the solution is added to the water. Suitable solvent media include the lower alkanols, e.g. methanol, ethanol, propanol, isopropanol, and mixtures thereof with or without added water. Isopropanol is preferred.

The solvent or medium component of the compositions varies depending upon the particular imide and/or salt component employed and the concentration desired. In general, the lower alkanol portion of the medium is in the range of from about 15 to 100 volume percent and the water portion is in the range of from about 0 to 85 volume percent. A medium in the range of from about 50 to 67 volume percent water is preferred.

The relative amounts of the imide and stannous salt components desirably used varies depending upon the condition of the industrial water in which the compositions of the invention are to be used. Satisfactory relative amounts by weight for each to the other as set forth above, are in a range of from about 0.5 to 10, preferably 0.8 to 2 and still more preferably about a 1 to 1 weight ratio.

In addition to a suitable medium for the agents and to enhance dispersion of the agents into water, the concentrates herein require an effective amount of a suitable wetting agent. An effective amount of a wetting agent is in the range of from about 0.1 to 5, preferably 0.3 to 1, weight percent of the inhibitor agent. In general, the use of an amount of wetting agent in excess of about 5 weight percent is neither deleterious nor enhancing, but is, of course, not cost effective. Particular and preferred wetting agents for use in the compositions herein described, are the polysorbate surfactants and mixtures thereof, preferably mono-9-octadeceneoate poly(oxy-1,2-ethanediyl) groups. The sorbitol surfactants effectively dispenses the inhibitors of the invention and also are believed to enhance corrosion prevention. Thus, in the absence of these surfactants less effective corrosion inhibition is experienced, and where a non-sorbitol type surfactant has been used, markedly inferior corrosion inhibition has been experienced. The sorbitol surfactants used herein are known and prepared conventionally as known in the art, e.g., by the reaction of ethylene oxide with the mon-ester or 9-octadeceneoic acid and sorbitol.

Stannous salts having an appreciable (at least 0.1 weight percent) solubility in water, in general, are suitable for use in the present invention. Representative stannous salts suitable for use, include the chloride and its dihydrate, acetate, butyrate, octanoate, isobutyrate, hexadecanoate, and the like salts. The chlorides are a preferred group. Most preferred are the salts of organic mono-carboxylic acids having a carbon atom content in the range of from about 1 to 16, preferably 4 to 10 carbon atoms.

EXAMPLE I

A solution of stannous chloride was prepared by heating and stirring a mixture of ethanol and the dihydrate of stannous chloride to about 65 degrees C. and then adding mono-9-octadeceneoate poly(oxy-1,2-ethanediyl) sorbitol (about 20 ethanediyl groups) surfactant (1% by weight of the ethanol-stannous chloride mixture). Additional ethanol was added to obtain about a 20 weight percent solution of stannous chloride.

SUCCINIMIDES

Succinimides of polyethylene polyamines are in general satisfactory for use in the invention. Preferred imides are those obtained from substituted succinic acids or acid anhydrides known in the art in which the substituent is a hydrocarbyl group having a carbon atom content in the range of from 1 to about 15, more preferably is an aliphatic hydrocarbon group and most preferably is an alkenyl group having a carbon atom content in the range of 3 to about 15. Representative alkenyl groups include n- and iso-octenyl, pentenyl, dodecenyl and the like, alkenyl groups. These substituted succinic acids or anhydrides are known and are prepared by conventional reactions, e.g., by the free radical catalyzed addition of alpha-olefines to maleic acid and its anhydride.

The polyethylene polyamine component of the imides satisfactory for use in the invention, contain from 1 to about 8 ethylene groups and from 2 to about 9 amino groups. Representative polyamines include ethylene diamine, diethylene triamine, triethylene tetramine, tetraethylene pentamine, pentaethylene hexamine, mixtures thereof, unfractionated e.g., crude preparative reaction product mixtures thereof and the like, polyethylene polyamines. Tetraethylene pentamine is preferred. The polyamines are known and prepared by conventional reactions known in the art.

EXAMPLE II

N-octenyl succinimide of tetraethylene pentamine was prepared by placing one mole of the amine in a reaction flask fitted with an additional funnel containing one mole of n-octenyl succinic anhydride, a water collector, a stirring and heating means and a reflux condenser. While stirring the amine, the anhydride in the funnel was slowly added to the flask. Upon completion of the addition, the resulting reaction mixture was heated to about 142 degrees C. where water of reaction started to distill over. At about 180 degrees C., the resulting reaction product, viz., n-octenyl succinimide of tetraethylene pentamine, was a clear bright orange liquid. About one mole of water was collected in the collector signifying that the imide-forming reaction was complete. The flask and its contents were then cooled to about 80 degrees C. and sufficient isopropanol and distilled water were added to yield a solution which was: (i) 40 volume percent isopropanol, (ii) about 60 volume percent water and (iii) about 30 weight percent imide. Into this solution, based upon the total weight of the solution, about 1 weight percent mono-9-octadeceneoate of poly(oxy-1,2-ethanediyl) sorbitol (about 20 ethanediyl groups) surfactant was added to facilitate effective dispersion of the imide agent when added to cooling water. The flask and its contents were maintained at about 80 degrees C. with stirring until a clear solution resulted. The cooled solution was ready for use in accordance with the invention.

The relative amounts of the imide and/or salt inhibitor components required for the compositions of the invention varies depending upon the solvent medium and practicality. Thus, as the composition is diluted further and further, larger and larger amounts of the inhibitor solution must be added to the cooling water in order to achieve an effective concentration. As a practical matter, the inhibitor component must be at least 5 weight percent of the solution and is usually in the range of from about 5 weight percent to about the saturated solution value. The preferred range is from about 20 to 40 weight percent, particularly about 30 weight percent.

The inhibitors of the invention are introduced into the water of the metal-water-air contact system using usual, conventionally known procedures, as practiced in the art. Thus, the inhibitor solution or solutions are stored in an attendant storage tank and are pump-metered into the water to be treated. The initial dosage may be larger than those later metered in, that is, excess inhibitor is introduced initially. Means are dynamically monitor the treatment process including monitoring the corrosion rate of a test sample placed in the system, chemical analysis of treated water samples, etc. Make-up water, of course, includes added inhibitor.

EXAMPLE III

The procedure of EXAMPLE I, supra, was repeated except that stannous octanoate was used in place of stannous chloride. The resulting solution was especially advantageous because in admixture with the imide solution of EXAMPLE II, supra, a stable solution resulted. This was in contrast wherein on standing, mixtures of the salt solution of EXAMPLE I with the imide solution of EXAMPLE II clouded up and some precipitation resulted. While the solutions of EXAMPLES I and II are desirably separately added to the water to be treated, note that they need not be where shelf life of the combined components is minimal. But the stannous organic carboxylate salt-imide solutions of EXAMPLE III always require but a single inlet irrespective of shelf life of the solution and provide corrosion inhibition effects as treatment of the water occurs at least as good as where separate additions of the salt and imide solutions of EXAMPLES I and II are made.

CORROSION TEST CONDITIONS

Corrosion tests were made using 1"×2"×⅛" carbon steel test coupons which were immersed and suspended in filtered brackish water (see TABLE I for analysis thereof) constrained in 1-liter glass flasks. The flasks were fitted with reflux condensers as well as means for bubbling air (at a rate of about 1.5 cubic feet per hour) through the flasks and contents thereof. A constant temperature of 65 degrees C. was maintained by immersing the flasks in a constant temperature water bath. The tests were of seven (7) days duration. The results are listed in TABLE II.

TABLE I

A TYPICAL BRACKISH WATER USED IN A UTILITY COOLING TOWER

| ANALYSIS | BRACKISH MAKE-UP, PPM UNLESS OTHERWISE NOTED | TOWER, PPM UNLESS OTHERWISE NOTED |
|---|---|---|
| pH | 9.2 | 9.4 |
| CONDUCTIVITY | 17,200 | 35,000 |
| TDS, MG/L | 8,650 | 18,340 |
| TSS, MG/L | 2.4 | 5 |

TABLE I-continued

| A TYPICAL BRACKISH WATER USED IN A UTILITY COOLING TOWER | | |
|---|---|---|
| ANALYSIS | BRACKISH MAKE-UP, PPM UNLESS OTHERWISE NOTED | TOWER, PPM UNLESS OTHERWISE NOTED |
| ORGANIC TOTAL, " | 15 | 31 |
| NITROGEN | 0.01 | 0.01 |
| NITRATE | | 18 |
| CHLORIDE | 13,000 | 64,000 |
| CARBONATE | 94 | 182 |
| BICARBONATE | 480 | 860 |
| SULFATE | 1,310 | 2,700 |
| PHOSPHATE | 2.8 | 8 |
| SODIUM | 5,710 | 13,000 |
| CALCIUM | 12 | 25 |
| MAGNESIUM | 3 | 5.2 |
| IRON | 0.6 | 1.3 |
| SILICON | 73 | 170 |
| POTASSIUM | 41 | 92 |
| BARIUM | 0.3 | 0.6 |
| "P" ALKALINITY | 355 | 844 |
| "M" AIKALINITY | 1,660 | 3,400 |

NOTE:
"P" ALKALINITY: The alkalinity above a pH of about 8.2
"M" ALKALINITY: The alkalinity between a pH of 4.3 & 8.2
TDS: Total Dissolved Solids
TSS: Total Suspended Solids

TABLE II

| | | TEST RESULTS | |
|---|---|---|---|
| TEST NO. | INHIBITOR (25 PPM) | RATE, PPM | CORROSION SURFACE CONDITION |
| 1. | SnCL2 | 0.86 | SMALL PIN PT. OXIDATION |
| 2. | A | 8.17 | WET OXIDATION, FILIFORM |
| 3. | SnCL2 & A | 2.48 | SMALL AREA OF OXIDATION |
| 4. | N-OCTENYL SUCCINIC ACID | 26.34 | LOTS OF OXIDATION, FILIFORM |
| 5. | B | 0.20 | ONE TINY SPOT @ HANGER PT. |
| 6. | C | 0.30 | ONE TINY SPOT @ HANGER PT. |
| 7-10. | B + C | 0.07 | NO VISIBLE CORROSION - |
| 11. | MOLYBDATE TYPE | 18.20 | SEVERE WET OXIDATION |
| 12. | ZINC & PHOSPHATE TYPE | 18.3 | SEVERE WET OXIDATION |
| 13. | ZINC & PHOSPHONATE TYPE | 8.7 | WET OXIDATION |
| 14. | NONE | 45.1 | SEVERE METAL WASTAGE |

NOTE:
A: N-ACTENYL SUCCIMIDE OF ALLYL AMINE
B: SnCL2 + SORBITOL SURFACTANT AS IN EXAMPLE I
C: N-OCTENYL SUCCINIMIDE AS IN EXAMPLE II

The data of TABLE II, supra, demonstrate that individually the stannous chloride and succinimide compositions herein are effective corrosion inhibitors for corrodible ferrous metal. It further demonstrates that the compositions of the invention acting in consort provide a corrosion system which is markedly superior to corrosion systems known and used in the prior art. These data further establish that the method of the invention provides effective protection for corrodible ferrous metals subject to the corrosive effects of water and air, especially of brackish water and air.

The foregoing is considered as illustrative only of the principles of the invention. Further, numerous modifications and changes can readily occur. For example, while the invention has been described in connection with corrosion protection of corrodible ferrous metal, other types of metals, such as copper and aluminum can also be protected by the principles of the invention. Therefore, it is to be understood that within the scope of the appended claims, the invention may be practiced other than as specifically described.

What is claimed is:

1. A method of inhibiting corrosion of a corrodible metal in a cooling water system including water, air which comprises maintaining in said water a minor amount of a stannous salt having at least 0.1 weight percent water solubility and a minor amount of a hydrocarbyl substituted succinimide of a polyethylene polyamine wherein (i) said substituent is aliphatic and contains in the range of 1 to 16 carbon atoms, (ii) said polyamine contains in the range of from 2 to about 8 ethylene groups and from 3 to about 9 amino groups, and (iii) said minor amounts are in the range of from about 0.1 to 100 parts per million parts of said water of said system.

2. The method of claim 1 wherein said minor amounts are in the range of from about 0.5 to 10 parts per million parts of said water of said system.

3. The method of claim 1 wherein said corrodible metal of said system is a ferrous metal.

4. The method of claim 1 wherein an effective amount of a polysorbate surfactant is also maintained in said water of said system.

5. The method of claim 4 wherein said surfactant is mono-9-octadeceneoate poly(oxy-1,2-ethanediyl) sorbitol containing in the range of from about 8 to 50 (1,2-ethanediyl) groups.

6. The method of claim 5 wherein said mono-9-octadeceneoate poly(oxy-1,2ethanediyl) sorbitol contains in the range of from about 15 to 25 (1, 2-ethanediyl) groups.

7. The method of claim 1 wherein said stannous salt is selected from the group consisting of stannous chloride and stannous salts of organic carboxylic acids having a carbon atom content in the range of from 1 to about 16 carbon atoms.

8. The method of claim 7 wherein said stannous salts of organic carboxylic acids have a carbon atom content in the range of from 4 to about 10 carbon atoms.

9. The method of claim 7 wherein said salt is stannous octanoate.

10. The method of claim 7 wherein said salt is stannous chloride.

11. The method of claim 7 wherein relative amounts of said imide to said stannous salt each to the other are in the range of from about 0.5 to 10 parts by weight.

12. The method of claim 7 wherein relative amounts of said imide to said stannous salt each to the other are in the range of from about 0.5 to 2 parts by weight.

13. The method of claim 7 wherein relative amounts of said imide to said stannous salt each to the other are in the range of from about 1 to 1 parts by weight.

14. A corrosion inhibiting composition consisting essentially of a stannous salt in an amount from 0.1 to 100 parts per million parts of said cooling water, a pre-treatment solvent medium and a polysorbate surfactant wherein (1) said amount of said stannous salt is in the range of from about 5 weight percent of said medium to the saturation value of said salt in said medium, (2) said medium has a lower alkanol content in the range of from about 15 to 100 volume percent and a water content in the range of up to 85 volume percent.

15. The composition of claim 14 which further comprises in an amount of from 0.1 to 100 parts per million parts of said cooling water a hydrocarbyl substituted succinimide of a polyethylene polyamine acting in concert with said stannous salt to cooperatively inhibit a corrodible metal from attack in said cooling water.

16. The composition of claim 15 wherein said stannous salt and said a hydrocarbyl substituted succinimide of a polyethylene polyamine are each from about 0.5 to 10 parts per million parts of said cooling water.

17. The composition of claim 14 wherein said amount of said salt in said medium is in the range of from about 20 to 40 weight percent of said medium.

18. The composition of claim 14 wherein said amount of said salt in said medium is about 30 weight percent of said medium.

19. The composition of claim 14 wherein said surfactant is mono-9-octadenceneoate poly(oxy-1,2-ethanediyl) sorbitol containing in the range of from about 8 to 50 (oxy-1,2-ethanediyl) groups.

20. The composition of claim 19 wherein said mono-9-octadeceneoate poly(oxy-1,2-ethanediyl) sorbitol contains in the range of from about 15 to 25 (1,2-ethanediyl) groups.

21. The composition of claim 20 wherein said salt is selected from the group consisting of stannous chloride and stannous salts of aliphatic mono-carboxylic acids having a carbon atom content in the range of from about 1 to 16, and said water content of said solvent medium is in the range of from up to 85 volume percent and said amount of surfactant is in the range of from about 0.1 to 5 weight percent of said stannous salt.

22. The composition of claim 21 in which said water content of said medium is in the range of from about 50 to 67 volume percent.

23. The composition of claim 21 in which said amount of surfactant is in the range of from about 0.3 to 1 weight percent of said stannous salt.

24. The composition of claim 21 in which said amount of surfactant is in the range of from about 1 to 1 weight percent of said stannous salt.

25. A corrosion inhibiting cooling water composition comprising, a hydrocarbyl substituted succinimide of a polyethylene polyamine in an amount from 0.1 to 100 parts per million parts of said cooling water;

a pre-treatment solvent medium and a polysorbate surfactant, wherein said amount of said imide is in the range of from at least 5 weight percent of said medium to about the saturation value of said imide in said medium wherein said hydrocarbyl substituent is selected from the group consisting of aliphatic groups having a carbon atom content in the range from 1 to about 16, said polyethylene polyamine contains from about 2 to about 8 ethylene groups and from 3 to about 9 amino groups, said medium has a lower alkanol content in the range of from about 15 to 100 volume percent and a water content in the range of from up to 85 volume percent.

26. The composition of claim 25 which further comprises in an amount of from 0.1 to 100 parts per million parts of said cooling water a stannous salt acting in concert with said hydrocarbyl substituted succinimide of a polyethylene polyamine, to cooperatively inhibit a corrodible metal from attack in said cooling water.

27. The composition of claim 26 wherein said stannous salt and said a hydrocarbyl substituted succinimide of a polyethylene polyamine are each from about 0.5 to 10 parts per million parts of said cooling water.

28. The composition of claim 27 wherein said corrodible metal is a ferrous metal.

29. The composition of claim 28 wherein said imide in said medium is in the range of from about 20 to 40 weight percent of said medium.

30. The composition of claim 25 wherein said surfactant is mono-9-octadenceneoate poly(oxy-1,2-ethanediyl) sorbitol containing in the range of from about 8 to 50 (oxy-1,2-ethanediyl) groups.

31. The composition of claim 30 wherein said mono-9-octadeceneoate poly(oxy-1,2-ethanediyl) sorbitol contains in the range of from about 15 to 25 (1,2-ethanediyl) groups.

32. The composition of claim 25 wherein said water content of said solvent medium is in the range of from about 50 to 67 volume percent of said medium.

33. The composition of claim 25 wherein said imide is octenylsuccinimide of tetraethylene pentamine.

34. A corrosion inhibiting cooling water composition comprising (i) a stannous salt in an amount from 0.1 to 100 parts per million parts of said cooling water, (ii) a hydrocarbyl substituted succinimide of a polyethylene polyamine in an amount from 0.1 to 100 parts per million parts of said cooling water, (iii) a pre-treatment solvent medium and (iv) a polysorbate surfactant wherein said amount of said salt and said amount of said imide are in the range of from about 5 weight percent of said medium to about the saturation value of said salt and imide in said medium wherein said hydrocarbyl substituent is selected from the group consisting of aliphatic groups having a carbon atom content in the range of from 1 to about 16, said polyethylene polyamine containing from about 2 to about 8 ethylene groups and from 3 to about 9 amino groups, said medium having a lower alkanol content in the range of from about 15 to 100 volume percent wherein said surfactant is selected from the group consisting of mono-9-octadeceneoate poly (oxy-1, 2-ethanediyl) sorbitols containing in the range of from 8 to 50 (oxy-1, 2-ethanediyl) groups, and wherein the relative amounts of said imide to said salt are in the range from about 0.5 to 10 parts by weight.

35. The composition of claim 34 wherein said stannous salt and said a hydrocarbyl substituted succinimide of a polyethylene polyamine are each from bout 0.5 to 10 parts per million parts of said cooling water.

36. The composition of claim 35 wherein said corrodible metal is a ferrous metal.

37. The composition of claim 34 wherein said water content of said solvent medium is in the range of from about 50 to 67 volume percent of said medium.

38. The composition of claim 34 wherein said mono-9-octadeceneoate poly (oxy-1, 2-ethanediyl) sorbitol contains in the range of from about 15 to 25 (1, 2-ethanediyl) groups.

39. The composition of claim 34 wherein said imide is octenylsuccinimide of tetraethylene pentamine.

40. The composition of claim 39 wherein said octenylsuccinimide of tetraethylene pentamine in said medium is in the range of from about 20 to 40 weight percent of said medium.

41. The composition of claim 39 wherein said octenylsuccinimide of tetraethylene pentamine in said medium is in the range of from about 30 weight percent of said medium.

42. The composition of claim 34 wherein the relative amounts of said imide to said salt each to the other are in the range from about 0.8 to 2 parts by weight.

43. The composition of claim 42 wherein the relative amounts of said imide to said salt each to the other are in the range from about 1 to 1 parts by weight.

44. The composition of claim 34 wherein said stannous salt is selected from the group consisting of stannous chloride and stannous salts of organic carboxylic acids having a carbon atom content in the range of from 1 to about 16 carbon atoms.

45. The composition of claim 44 wherein said stannous salts of organic carboxylic acids have a carbon atom content in the range of from 4 to about 10 carbon atoms.

46. The composition of claim 45 wherein said salt is stannous octanoate.

* * * * *